United States Patent [19]

Wilson

[11] Patent Number: 4,991,213

[45] Date of Patent: Feb. 5, 1991

[54] SPEECH SPECIFIC ADAPTIVE TRANSFORM CODER

[75] Inventor: Philip J. Wilson, San Diego, Calif.

[73] Assignee: Pacific Communication Sciences, Inc., San Diego, Calif.

[21] Appl. No.: 199,015

[22] Filed: May 26, 1988

[51] Int. Cl.[5] ..... G10L 9/04; G10L 9/18

[52] U.S. Cl. ..... 381/34; 381/35

[58] Field of Search ..... 381/29–40, 381/45–50; 364/513.5

[56] References Cited

U.S. PATENT DOCUMENTS

| | | | |
|---|---|---|---|
| 3,405,237 | 10/1968 | David et al. | 381/49 |
| 3,662,108 | 5/1972 | Flanagan | 381/47 |
| 4,058,676 | 11/1977 | Wilkes et al. | 381/29 |
| 4,184,049 | 1/1980 | Crochiere et al. | 381/31 |
| 4,230,906 | 10/1980 | Davis | 381/49 |
| 4,455,649 | 6/1984 | Esteban et al. | 381/29 |
| 4,535,472 | 8/1985 | Tomcik | 381/31 |
| 4,569,075 | 2/1986 | Nussbaumer | 381/29 |

OTHER PUBLICATIONS

Max, Joel, "Quantization for Minimum Distortion", IRE Transactions on Information Theory, vol. IT-6, pp. 7–12 (Mar. 1960).

Zelinski, R., et al., "Adaptive Transform Coding of Speech Signals", IEEE Transactions on Acoustics, Speech, and Signal Processing, vol. ASSP-25, No. 4, pp. 299–309 (Aug. 1977).

Zelinski, R., et al., "Approaches to Adaptive Transform Speech Coding at Low Bit Rates", IEEE Transactions on Acoustics, Speech, and Signal Processing, vol., ASSP-27, No. 1, pp. 89–95 (Feb. 1979).

Tribolet, J., et al., "Frequency Domain Coding of Speech", IEEE Transactions on Acoustics, Speech and Signal Processing, vol. ASSP-27, No. 3, pp. 512–530 (Oct. 1979).

Crochiere, R., et al., "Real-Time Speech Coding", IEEE Transaction on Communications, vol. COM-30, No. 4, pp. 621–634 (Apr. 1982).

Makhoul, John, "Linear Prediction: A Tutorial Review", Proceedings of the IEEE, vol. 63, No. 4 (Apr. 1975).

Wilson, Philip J., "Frequency Domain Coding of Speech Signals", Thesis Submitted for Degree of Doctor of Philosophy of the University of London and the Diploma of Membership of Imperial College, Catalogued, Sep. 9, 1983.

*Primary Examiner*—Gary V. Harkcom

*Assistant Examiner*—David D. Knepper

*Attorney, Agent, or Firm*—Woodcock Washburn Kurtz Mackiewicz & Norris

[57] ABSTRACT

A transform coder operates on a sampled speech signal transformed from the time domain to a frequency domain to develop pitch information in relation to a given speech signal. The coder segregates groups of information samples into blocks, transforms each block of samples, and generates an auto-correlation function of the transformed signal for each block. Next, the coder determines the pitch period and pitch gain from the auto-correlation function, and determines the striation magnitude and energy from the pitch period and pitch gain. Then a reference pitch model including a number of data points is retrieved from data memory. A striation scaling factor is generated in response to the striation magnitude and energy, and is multiplied by each of the retrieved data points to adaptively generate a pitch model. Finally, the adaptively determined model is sampled to establish the pitch information.

8 Claims, 6 Drawing Sheets

SPEECH SPECIFIC ADAPTIVE TRANSFORM CODER

RELATED APPLICATIONS

The present application is related to the following applications all of which were filed simultaneously and are owned by the same assignee, namely, Improved Adaptive Transform Coder bearing Ser. No. 199,360, filed May 26, 1988 and Dynamic Scaling in an Adaptive Transform Coder bearing Ser. No. 199,347, filed May 26, 1988.

1. Field of the Invention

The present invention relates to the field of speech coding, and more particularly, to improvements in the field of adaptive transform coding of speech signals wherein the coding bit rate is maintained at a minimum.

2. Background of the Invention

Telecommunication networks are rapidly evolving towards fully digital transmission techniques for both voice and data. One of the first digital carriers was the 24-voice channel 1.544 Mb/s T1 system, introduced in the United States in approximately 1962. Due to advantages over more costly analog systems, the T1 system became widely deployed. An individual voice channel in the T1 system is generated by band limiting a voice signal in a frequency range from about 300 to 3400 Hz, sampling the limited signal at a rate of 8 kHz, and thereafter encoding the sampled signal with an 8 bit logarithmic quantizer. The resultant signal is a 64 kb/s digital signal. The T1 system multiplexes the 24 individual digital signals into a single data stream.

A T1 system limits the number of voice channels in a single grouping to 24. In order to increase the number of channels and still maintain a transmission rate of approximately 1.544 Mb/s, the individual signal transmission rate must be reduced from a rate of 64 kb/s. One method used to reduce this rate is known as transform coding.

In transform coding of speech signals, the individual speech signal is divided into sequential blocks of speech samples. The samples in each block are thereafter arranged in a vector and transformed from the time domain to an alternate domain, such as the frequency domain. Transforming the block of samples to the frequency domain creates a set of transform coefficients having varying degrees of amplitude. Each coefficient is independently quantized and transmitted. On the receiving end, the samples are de-quantized and transformed back into the time domain. The importance of the transformation is that the signal representation in the transform domain reduces the amount of redundant information, i.e. there is less correlation between samples. Consequently, fewer bits are needed to quantize a given sample block with respect to a given error measure (eg. mean square error distortion) than the number of bits which would be required to quantize the same block in the original time domain.

An example of such a prior transform coding system is shown in greater detail in FIG. 1. A speech signal is provided to a buffer 10, which arranges a predetermined number of successive samples into a vector x. Vector x is linearly transformed from the time domain to an alternate domain using a unitary matrix A by transform member 12, resulting in vector y. The elements of vector y are quantized by quantizer 14, yielding vector Y, which vector is transmitted. Vector Y is received and de-quantized by de-quantizer 16, and transformed back to the time domain by inverse transform member 18, using the inverse matrix $A^{-1}$. The resulting block of time domain samples are placed back into successive sequence by buffer 20. The output of buffer 20 is ideally the reconstructed original signal.

While the transform coding scheme in theory provided satisfaction of the need to reduce the bit rate of individual T1 channels, historically the quantization process produced unacceptable amounts of noise and distortion. To a large extent, the noise and distortion problems emanated from two areas: the inability of various transform matrices to efficiently transform the original signal; and from the distortion and noise created in the quantization process.

In an attempt to optimize transform efficiency, various transform matrices have been evaluated. It is generally agreed that the optimal transform matrix is the Karhunen-Loeve Transform (KLT). The problem with this transform, however, is that it lacks a fast computation algorithm and the matrix is signal-dependent. Consequently, other transforms have been investigated, for example, the Walsh-Hadamard Transform (WHT), the discrete slant transform (DST), the discrete Fourier Transform (DFT), the symmetric discrete Fourier Transform (SDFT), and the discrete cosine transform (DCT). The SDFT and DCT appear to be closest in efficiency to the KLT, are signal-independent and include fast algorithms.

In attempting to resolve the distortion and noise problems, previous investigations centered on the quantization process. Quantization is the procedure whereby an analog signal is converted to digital form. Max, Joel "Quantization for Minimum Distortion" IRE Transactions on Information Theory, Vol. IT-6 (March, 1960), pp. 7-12 (MAX) discusses this procedure. In quantization the amplitude of a signal is represented by a finite number of output levels. Each level has a distinct digital representation. Since each level encompasses all amplitudes falling within that level, the resultant digital signal does not precisely reflect the original analog signal. The difference between the analog and digital signals is the quantization noise. Consider for example the uniform quantization of the signal x, where x is any real number between 0.00 and 10.00, and where five output levels are available, at 1.00, 3.00, 5.00, 7.00 and 9.00, respectively. The digital signal representative of the first level in this example can signify any real number between 0.00 and 2.00. For a given range of input signals, it can be seen that the quantization noise produced is inversely proportional to the number of output levels. In early quantization investigations for transform coding, it was found that not all transform coefficients were being quantized and transmitted at low bit rates.

Initial quantization investigations involved quantizers having logarithmic characteristics and having bit assignment schemes which were used to determine the optimum number of bits to be assigned by the quantizer to a given sample block containing a number of transform coefficients. Such schemes utilized formulae which took into account an averaged mean-squared distortion of the transformed signal over long periods. Approaches of this type were deemed to be fixed bit allocation processes because bit assignment and step-size are fixed a priori and are based upon long term speech statistics. As indicated above, a major problem which occurred at lower bit rates was the lack of a sufficient number of bits to quantize all of the speech samples or coefficients in each block. Some speech samples were lost. Consequently, distortion noise utilizing these schemes remained unsatisfactory at lower bit rates.

Further attempts to improve the transform coding distortion noise problem at lower bit rates, involved investigating the quantization process using dynamic bit assignment and dynamic step-size determination processes. Bit assignment was adapted to short term statistics of the speech signal, namely statistics which occurred from block to block, and step-size was adapted to the transform's spectral information for each block. These techniques became known as adaptive transform coding methods.

In adaptive transform coding, optimum bit assignment and step-size are determined for each sample block usually by adaptive algorithms which require certain knowledge about the variance of the amplitude of the transform coefficients in each block. The spectral envelope is that envelope formed by the variances of the transform coefficients in each sample block. Knowing the spectral envelope in each block, thus allows a more optimal selection of step size and bit allocation, yielding a more precisely quantized signal having less distortion and noise.

Since variance or spectral envelope information is developed to assist in the quantization process, this same information will be necessary in the de-quantization process. Consequently, in addition to transmitting the quantized transform coefficients, adaptive transform coding also provides for the transmission of the variance or spectral envelope. This is referred to as side information. Since the overall objective in adaptive transform coding is to reduce bit rate, the actual variance information is not transmitted as side information, but rather, information from which the spectral envelope may be determined is transmitted.

The spectral envelope represents in the transform domain the dynamic properties of speech, namely formants. Speech is produced by generating an excitation signal which is either periodic (voiced sounds), a periodic (unvoiced sounds), or a mixture (eg. voiced fricatives). The periodic component of the excitation signal is known as the pitch. During speech the excitation signal is filtered by a vocal tract filter, determined by the position of the mouth, jaw, lips, nasal cavity, etc. This filter has resonances or formants which determine the nature of the sound being heard. The vocal tract filter provides an envelope to the excitation signal. Since this envelope contains the filter formants, it is known as the formant or spectral envelope.

Speech production can be modeled whereby speech characteristics are mathematically represented by convolving the excitation signal and vocal tract filter. In such a model, the vocal tract filter frequency response, i.e. the spectral envelope, is an estimate of the variance of the transform coefficients of the speech signal in the frequency domain. Hence, the more precise the determination of the spectral envelope, the more optimal the step-size and bit allocation determinations used to code transformed speech signals. Thus, adaptive transform coding techniques appear capable of efficiently coding and transmitting individual voice signals at lower bit rates.

In view of the above, adaptive transform coding research has concentrated on various techniques for more precisely determining the spectral envelope. One early technique disclosed in Zelinski, R. et al. "Adaptive Transform Coding of Speech Signals" IEEE Transactions on Acoustics, Speech, and Signal Processing, Vol. ASSP-25, No. 4 (August, 1977), pp. 299–309 and Zelinski, R. et al. "Approaches to Adaptive Transform Speech Coding at Low Bit Rates" IEEE Transactions on Acoustics, Speech, and Signal Processing, Vol. ASSP-27, No. 1 (February, 1979), pp. 89–95 involved estimation of the spectral envelope by squaring the transform coefficients, and averaging the coefficients over a preselected number of neighboring coefficients. The magnitude of the averaged coefficients were themselves quantized and transmitted with the coded signal as side information. To obtain the spectral estimates of all coefficients, the averaged coefficients were geometrically interpolated (i.e. linearly interpolated in the log domain). The result was a piecewise approximation of the spectral levels, i.e. variances, in the frequency domain. These values were then used by the bit assignment and step-size algorithms.

While it demonstrated acceptable distortion and noise at bit rates lower than 64 kb/s, the problem with this early technique was that it had a limit approximately between 16 and 20 kb/s. Below this limit, some of the same problems exhibited by previous transform coding techniques were present, namely, the failure to quantize certain of the transform coefficients due to a lack of a sufficient number of bits per block. Consequently, certain essential speech elements were lost. One reason for losing the essential speech elements with this early technique was that it was nonspeech specific in the sense that it did not take into account the known properties of speech, such as the all-pole vocal-tract model and the pitch model in determining the variance information and bit allocation.

In an attempt to utilize adaptive transform coding at bit rates of 16 kb/s or lower, efforts were made to develop speech specific adaption algorithms. In speech specific techniques one should account for both pitch and formant information in a speech signal. Consequently, the transform scheme utilized in an adaptive transform coder should not only produce a spectral envelope but preferably includes a modulating term which can be utilized for reflecting pitch striations.

One speech specific technique disclosed in Tribolet, J. et al. "Frequency Domain Coding of Speech" IEEE Transactions on Acoustics, Speech, and Signal Processing, Vol. ASSP-27, No. 3 (October, 1979), pp. 512–530, utilizing the DCT to obtain the transform coefficients, determined the DCT spectral envelope by first squaring the DCT coefficients and then inverse transforming the squared coefficients using an inverse DFT. The resultant time domain sample block yielded an autocorrelation-like function, which was termed the pseudo-ACF. The values of a number of initial block samples were then used to define a correlation matrix in an equation format. The solution of the equation resulted in a linear prediction model made up of linear prediction coefficients. The inverse spectrum of the linear prediction coefficients yielded a precise estimation of the DCT spectral envelope. In order to develop a pitch pattern, it was necessary to obtain a pitch period and a pitch gain. To determine these two factors, this technique searched the pseudo-ACF to determine a maximum value which became the pitch period. The pitch gain was thereafter defined as the ratio between the value of the pseudo-ACF function at the point where the maximum value was determined and the value of the pseudo-ACF at its origin. The estimated spectral envelope and the generated pitch pattern were thereafter used in conjunction with the step-size and bit assignment algorithms.

It was stated that the above speech specific technique worked better at lower bit rates, i.e. 16 kb/s, than previous adaptive transform coding techniques, because it forced the assignment of bits to many pitch harmonics, i.e. essential speech elements, which previously would not have been transmitted and it helped to preserve pitch structure information. The problem with this technique however is that due to its computational complexity, i.e. the technique required a 2N-point FFT operation, a magnitude operation, and a normalizing operation. As concluded in Crochiere, R. et al. "Real-Time Speech Coding" IEEE Transactions on Communications, Vol. COM-30, No. 4 (April, 1982), pp. 621–634 an array processor was needed for implementation. Consequently, it was not economical with regard to either processing time or cost.

Accordingly, a need still exists for an adaptive transform coder which is capable of efficient operation at low bit rates, has low noise levels, and which is capable of reasonable cost and processing time implementation.

There is also a need to design a coder which is capable of optimal performance over a wide dynamic range of input signals while maintaining a high signal-to-noise ratio at all levels. This has been attempted previously by: careful control of input levels to correctly bias A/D conversion; analog AGC prior to A/D conversion; and digital AGC after A/D conversion. Careful control of the input levels is seldom viable because most, if not all, signals come from external sources. AGC prior to A/D conversion is possible if control is maintained over the analog interface. However problems typically encountered with such procedures involve rise and fall times as well as background noise amplification. Also, inverse AGC at the receiver is not possible. Digital AGC follows the problems encountered in analog AGC and also introduces a degree of quantization noise which may not be removed.

There is still a further need for an adaptive transform coder which conducts a post bit allocation process to assure that each coefficient to be quantized is an integer. In performing bit assignment one or more calculations are used to determine the number of bits needed to quantize a particular piece of information, i.e. a transform coefficient. Such calculations do not usually yield integer numbers, but rather, result in real numbers which included an integer and a decimal fraction, e.g. 3.66, 5.72, or 2.44. If bits are only assigned to the integer portion of the calculated value and the details of the decimal fraction portions are ignored due to the limited number of available bits important information could be lost or distortion noise could be increased. Consequently, a need exists to account for the decimal fraction information and minimize the distortion noise.

SUMMARY OF THE INVENTION

It an object of the invention to provide a method and apparatus for adaptive transform coding which is speech specific.

It is still another object of the invention to provide a method and apparatus for adaptive transform coding wherein the pitch structure of speech is preserved in the coding process.

These and other objects of the invention are achieved in an apparatus and method for developing pitch information in relation to a given speech signal in a transform coder is disclosed, which coder operates on a sampled time domain information signal composed of information samples, which coder sequentially segregates groups of information samples into blocks, which coder transforms each block of samples from the time domain to a transform domain, which coder generates an auto-correlation function of the transformed signal for each block, and which coder includes a data memory, the apparatus and method including determining the pitch period and the pitch gain from the auto-correlation function; determining the striation magnitude and energy from the pitch period and pitch gain; reference means for retrieving from the data memory a reference pitch model which model includes a number of data points; generating a striation scaling factor in response to the magnitude and energy; multiplying the striation scaling factor by each of the data points thereby generating a pitch model having a number of adaptively determined points; and sampling the adaptively determined points which sampling establishes the pitch information.

These and other objects and advantages of the invention will become more apparent from the following detailed description when taken in conjunction with the following drawings.

DETAILED DESCRIPTION OF THE PREFERRED EMBODIMENT

As will be more completely described with regard to the figures, the present invention is embodied in a new and novel apparatus and method for adaptive transform coding.

Figure 1:
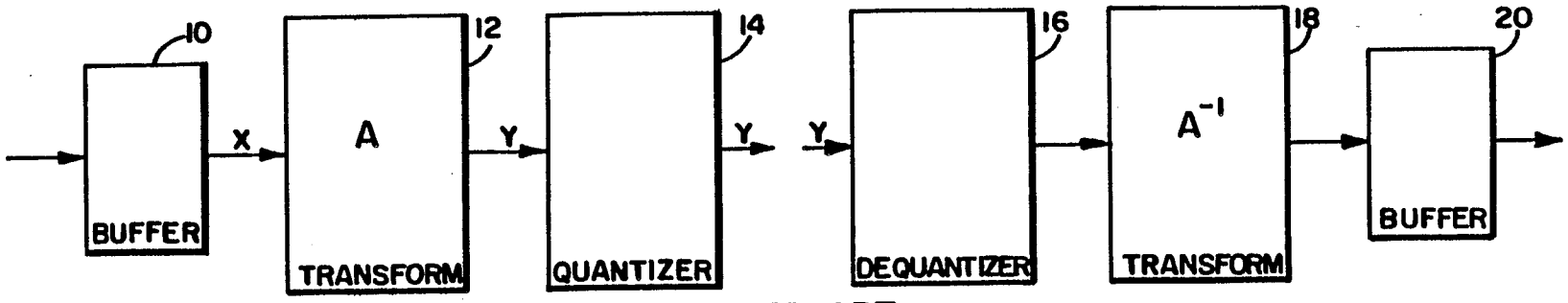
PRIOR ART FIG. 1
FIG. 1 is a diagrammatic view of a prior transform coder.
Figure 2:
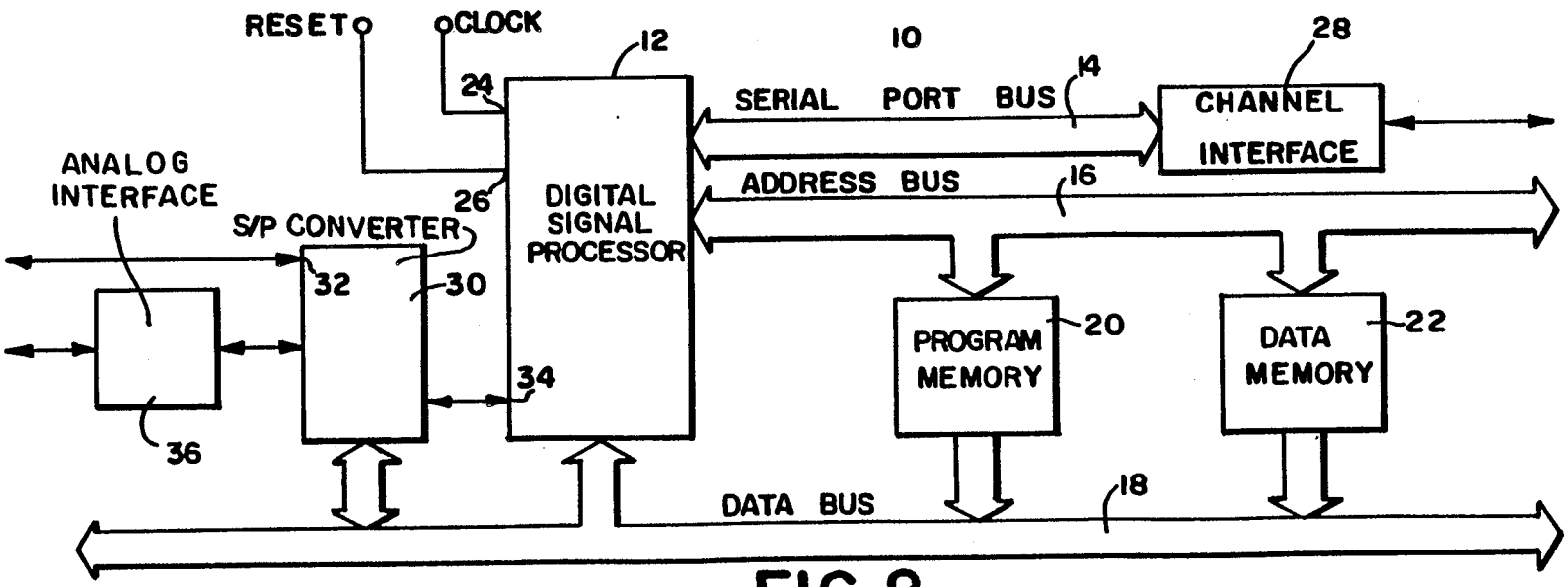
FIG. 2 is a schematic view of an adaptive transform coder in accordance with the present invention.

An adaptive transform coder in accordance with the present invention is depicted in FIG. 2 and is generally referred to as 10. The heart of coder 10 is a digital signal processor 12, which in the preferred embodiment is a TMS320C25 digital signal processor manufactured and sold by Texas Instruments, Inc. of Houston, Tex. While such a processor is capable of processing pulse code modulated signals having a word length of 16 bits, the word length of signals envisioned for coding by the present invention is somewhat less than 16 bits. Processor 12 is shown to be connected to three major bus networks, namely serial port bus 14, address bus 16, and data bus 18. Program memory 20 is provided for storing the programming to be utilized by processor 12 in order to perform adaptive transform coding in accordance with the present invention. Such programming is explained in greater detail in reference to FIGS. 3 through 10. Program memory 20 can be of any conventional design, provided it has sufficient speed to meet the specification requirements of processor 12. It should be noted that the processor of the preferred embodiment (TMS320C25) is equipped with an internal memory. Although not yet incorporated, it is preferred to store the adaptive transform coding programming in this internal memory.

Data memory 22 is provided for the storing of data which may be needed during the operation of processor 12, for example, logarithmic tables the use of which will become more apparent hereinafter.

A clock signal is provided by conventional clock signal generation circuitry, not shown, to clock input 24. In the preferred embodiment, the clock signal provided to input 24 is a 40 MHz clock signal. A reset input 26 is also provided for resetting processor 12 at appropriate times, such as when processor 12 is first activated. Any conventional circuitry may be utilized for providing a signal to input 26, as long as such signal meets the specifications called for by the chosen processor.

Processor 12 is connected to transmit and receive telecommunication signals in two ways. First, when communicating with adaptive transform coders similar to the invention, processor 12 is connected to receive and transmit signals via serial port bus 14. Channel interface 28 is provided in order to interface bus 14 with the compressed voice data stream. Interface 28 can be any known interface capable of transmitting and receiving data in conjunction with a data stream operating at 16 kb/s.

Second, when communicating with existing 64 kb/s channels or with analog devices, processor 12 is connected to receive and transmit signals via data bus 18. Converter 30 is provided to convert individual 64 kb/s channels appearing at input 32 from a serial format to a parallel format for application to bus 18. As will be appreciated, such conversion is accomplished utilizing codes and serial/parallel devices which are capable of use with the types of signals utilized by processor 12. In the preferred embodiment processor 12 receives and transmits parallel 16 bit signals on bus 18. In order to further synchronize data applied to bus 18, an interrupt signal is provided to processor 12 at input 34. When receiving analog signals, analog interface 36 serves to convert analog signals by sampling such signals at a predetermined rate for presentation to converter 30. When transmitting, interface 36 converts the sampled signal from converter 30 to a continuous signal.

Figure 3:
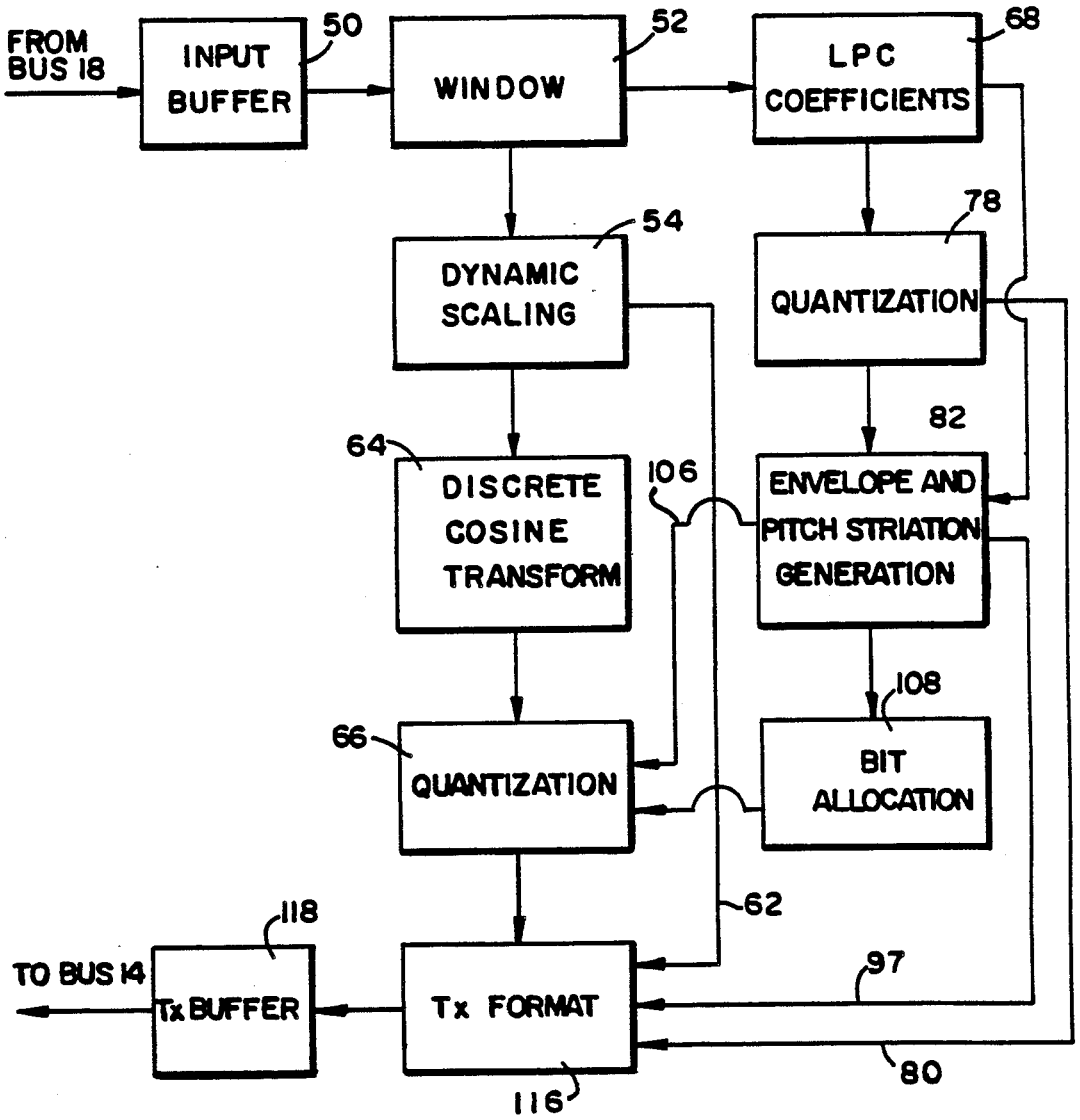
FIG. 3 is a general flow chart of those operations performed in the adaptive transform coder shown in FIG. 2, prior to transmission.

With reference to FIGS. 3–10, the programming will be explained which, when utilized in conjunction with those components shown in FIG. 2, provides a new and novel adaptive transform coder. Adaptive transform coding for transmission of telecommunications signals in accordance with the present invention is shown in FIG. 3. Telecommunication signals to be coded and transmitted appear on bus 18 and are presented to input buffer 50. It will be recalled that such telecommunication signals ar sampled signals made up of 16 bit PCM representations of each sample. It will also be recalled that sampling occurs at a frequency of 8 kHz. For purposes of the present description, assume that a voice signal sampled at 8 kHz is to be coded for transmission. Buffer 50 accumulates a predetermined number of samples into a sample block. In the preferred embodiment, there are 128 samples in each block. Each block of samples is windowed at 52. In the preferred embodiment the windowing technique utilized is a trapezoidal window [h(sR-M)]where each block of M speech samples are overlapped by R samples.

Each block of M samples is dynamically scaled at 54. Dynamic scaling serves to both increase the signal-to-noise ratio on a block by block basis and to optimize processor parameters to use the full dynamic range of processor 12 on a short term basis. Thus a high signal-to-noise ratio is maintained.

Figure 5:
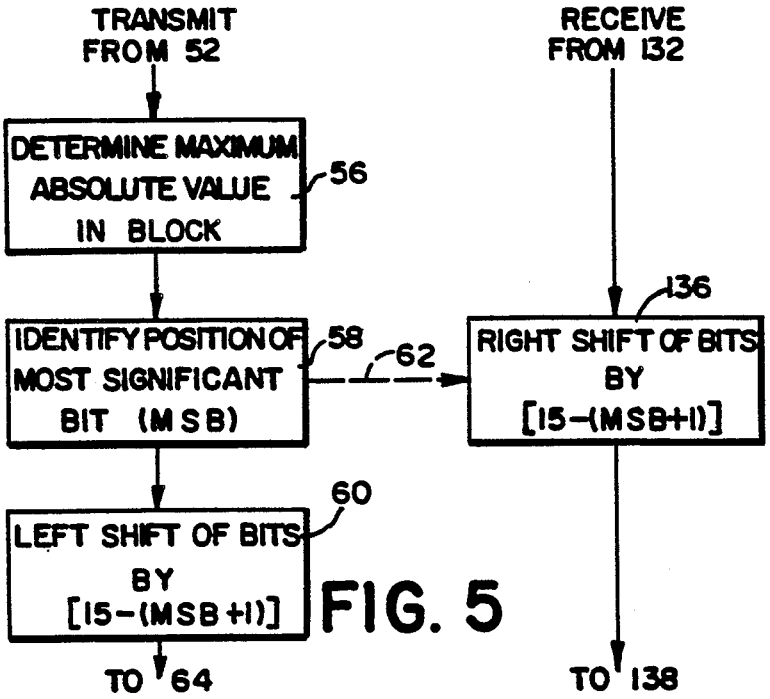
FIG. 5 is a more detailed flow chart of the dynamic scaling operation shown in FIGS. 3 and 4.

With reference to FIG. 5, dynamic scaling is shown to be achieved by first determining the maximum value in the subject block. Once the maximum value is determined at 56, the position of the most significant bit (MSB) of such maximum value is located at 58. For example, assume that the maximum value of a subject block is a 16 bit binary representation of the number 6 (i.e. 0000 0000 0000 0110). The word length of the processor is 16, while the word length of number 6 is only 3, the position of the most significant bit (i.e. position 3, if counting from 1 from right to left). The value of each position in this example is equal to the position number, i.e. position 3 has a value of 3 and position 16 has a value of 16. The binary representations are now shifted to the left at 60 according to the formula:

$$\text{Left Shift of MSB} = [15-(\text{MSB}+1)] \quad (1)$$

The number 15 is representative of the highest MSB position for a 16-bit word length. The binary representation of the number 6 would then be shifted eleven positions to the left (i.e. 0011 0000 0000 0000).

Reception of a dynamically scaled block of samples requires an opposite operation to be performed. Consequently, the amount of left shift needs to be transmitted as side information. In the preferred embodiment the position of the most significant bit is transmitted with each block as side information at 62. Since (1) assures that the left shift number will never exceed 15 for a 16 bit processor, no more than 4 bits are required to transmit this side information in a binary form. It will be noted that the amount of left shift is incremented by 1. This increment allows a margin for processing gains without overflow.

Having dynamically scaled the subject sample block at 54 in FIG. 3, the subject block is transformed from the time domain to the frequency domain utilizing a discrete cosine transform at 64. Such transformation results in a block of transform coefficients which are quantized at 66. Quantization is performed on each transform coefficient by means of a quantizer optimized for a Gaussian signal, which quantizers are known (See MAX). The choice of gain (step-size) and the number of bits allocated per individual coefficient are fundamental to the adaptive transform coding function of the present invention. Without this information, quantization will not be adaptive. In order to develop the gain and bit allocation per sample per block, consider first a known formula for bit allocation:

$$R_i = R_{ave} + 0.5 * \log_2 [v_i^2/V_{block}^2] \quad (2)$$

where:

-continued $$V^2_{block} = n^{th} \text{ root of } [\text{Product}_{i=1,N}\, v_i^2] \quad (3)$$
$$R_{Total} = \text{Sum}_{i=1,N}\, [R_i]$$

where:

$R_i$ is the number of bits allocated to the $i^{th}$ DCT coefficient;

$R_{Total}$ is the total number of bits available per block;

$R_{ave}$ is the average number of bits allocated to each DCT coefficient;

$v_i^2$ is the variance of the $i^{th}$ DCT coefficient; and $V_{block}^2$ is the geometric mean of $v_i$ for DCT coefficients.

Equation (2) is a bit allocation equation from which the resulting $R_i$, when summed, should equal the total number of bits allocated per block. The following new derivation considerably reduces implementation requirements and solves dynamic range problems associated with performing calculations using 16-bit fixed point arithmetic, as is required when utilizing the processor of the preferred embodiment. Equation (2) may be reorganized as follows:

$$R_i = [R_{ave} - \log_2(V_{block}^2)] + 0.5^* \log_2(v_i^2) \quad (5)$$

Since the terms within square brackets can be calculated beforehand and since they are not dependent on the coefficient index (i), such terms are constant and may be denoted as Gamma. Hence equation (5) may be rewritten as follows:

$$R_i = \text{Gamma} + 0.5^* S_i \quad (6)$$

$$S_i = \log_2(v_i^2) \quad (7)$$

The term $v_i^2$ is the variance of the $i^{th}$ DCT coefficient or the value the $i^{th}$ coefficient has in the spectral envelope. Consequently, knowing the spectral envelope allows the solution to the above equations. A new technique has been developed for determining the spectral envelope of the DCT spectrum. The spectral envelope has been defined as follows:

$$H(z) = \text{Gain}/(1 + \text{Sum}_{k=1,P}[a_k * z^{-k}]) \quad (8)$$
$$\text{evaluated at: } z = e^{j\,2\,pi\,(i/2N)}\ [i = 0, N-1]$$

where H(z) is the spectral envelope of DCT and $a_k$ is the linear prediction coefficient. Thus equation (8) defines the spectral envelope of a set of LPC coefficients. The spectral envelope in the DCT domain may be derived by modifying the LPC coefficients and then evaluating (8).

As shown in FIG. 3, the windowed coefficients are acted upon to determine a set of LPC coefficients at 68. The technique for determining the LPC coefficients is shown in greater detail in FIG. 6. The windowed sample block is designated x(n) at 70. An even extension of x(n) is generated at 72, which even extension is designated y(n). Further definition of y(n) is as follows:

$$\begin{aligned} y(n) &= x(n) & n &= 0, N-1 \\ &= x(2N-1-n) & n &= N, 2N-1 \end{aligned} \quad (9)$$

An autocorrelation function (ACF) of (9) is generated at 74. The ACF of y(n) is utilized as a pseudo-ACF from which LPCs are derived in a known manner at 76. Having generated the LPCs ($a_k$), equation (8) can now be evaluated to determine the spectral envelope. It will be noted that the pseudo-ACF, in addition to being available at 76, is also provided to 82 for the development of pitch striation information. It will be also noted in FIG. 3, that in the preferred embodiment the LPCs are quantized at 78 prior to envelope generation. Quantization at this point serves the purpose of allowing the transmission of the LPCs as side information at 80.

Figure 7:
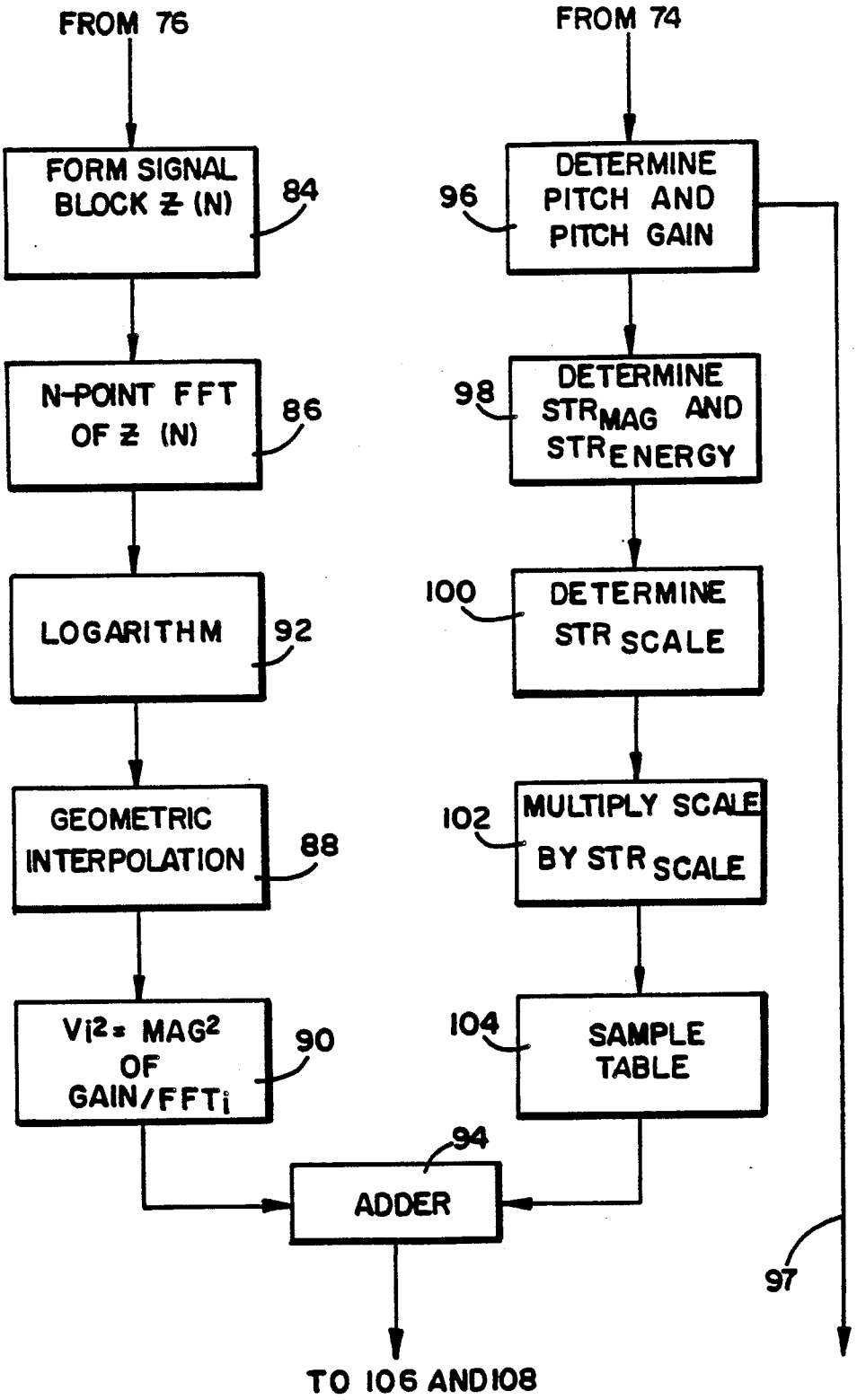
FIG. 7 is a more detailed flow chart of the envelope generation operation shown in FIGS. 3 and 4.
Figure 6:
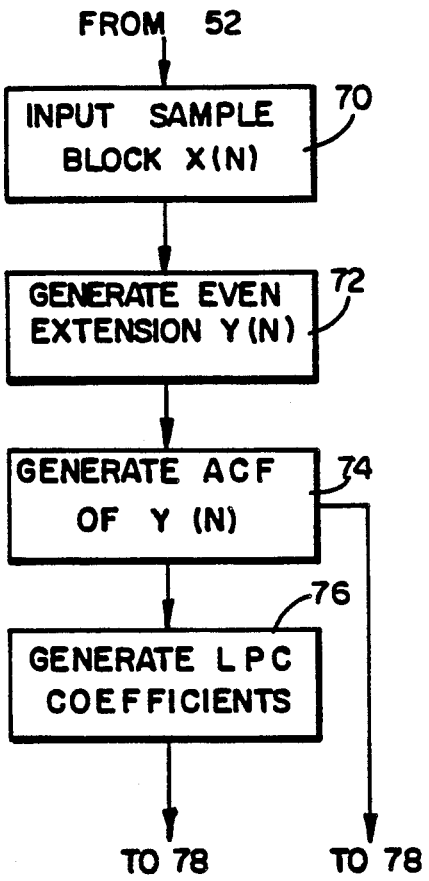
FIG. 6 is a more detailed flow chart of the LPC coefficients operation shown in FIGS. 3 and 4.

As shown in FIG. 3, the spectral envelope and pitch striation information is determined at 82. A more detailed description of these determinations is shown in FIG. 7. Consider first the determination of the spectral envelope. A signal block z(n) is formed at 84, which block is reflective of the denominator of Equation (8). The block z(n) is further defined as follows:

$$\begin{aligned} z(n) &= 1.0 & n &= 0 \\ &= a_n & n &= 1, P \\ &= 0.0 & n &= P+1, 2N-1 \end{aligned} \quad (10)$$

Block z(n) is thereafter evaluated using a fast fourier transform (FFT). More specifically, z(n) is evaluated at 86 by using an N-point FFT where z(n) only has values from 0 to N−1. Such an operation yields the results $v_i^2$ for i=0, 2, 4, 6, . . . , N−2. Since (7) requires the $\text{Log}_2$ of $v_i^2$, the logarithm of each variance is determined at 88. To get the odd ordered values, geometric interpolation is performed at 90 in the log domain of $v_i^2$ using the following formula for i=1 , 3, 5, . . . , N−1:

$$VL(i) = -0.25^* VL(i-3) + 0.75^* VL(i-1) + 0.75^* VL(i+1) - 0.25^* VL(i+3) \quad (11)$$

where $VL(i) = \text{Log}_2\,(v_i^2)$.

It is also possible, although not preferred, to utilize a 2N-point FFT to evaluate z(n). In such a situation it will not be necessary to perform any interpolation. The problem with using a 2N-point FFT is that it takes more processing time than the preferred method since the FFT is twice the size.

The variance ($v_i^2$) is determined at 92 for each DCT coefficient determined at 64. The variance $v_i^2$ is defined to be the magnitude$^2$ of (8) where H(z) is evaluated at $$z = e^{j\,2\,pi\,(I/2N)}\ \text{for } i = 0, N = 1.$$

Put more simply, consider the following:

$$v_i^2 = \text{Mag.}^2 \text{ of } [\text{Gain}/\ \text{FFT}_i] \quad (12)$$

The term $v_i^2$ is now relatively easy to determine since the $\text{FFT}_i$ denominator is the $i^{th}$ FFT coefficient determined at 90. Having determined the spectral envelope, i.e. the variance of each DCT coefficient determined at 64, these values are provided to 94 for combination with the pitch information.

It will be recalled that one reason for losing essential speech elements in early adaptive transform coders was that such coders were nonspeech specific. In speech specific techniques both pitch and formant (i.e. spectral envelope) information are taken into account. It will also be recalled that a prior speech specific technique took pitch information, or pitch striations, into account by generating a pitch model from the pitch period and the pitch gain. To determine these two factors, this technique searched the pseudo-ACF to determine a maximum value which became the pitch period. The pitch gain was thereafter defined as the ratio between the value of the pseudo-ACF function at the point where the maximum value was determined and the value of the pseudo-ACF at its origin. With this information the pitch striations, i.e. a pitch pattern in the frequency domain, could be generated which information can be defined as follows:

$$F_{pitch}(k)\ K=0, N-1 \tag{13}$$

To generate the pitch pattern in the frequency domain using this prior technique, one would define a time domain impulse sequence, p(n) as follows:

$$p(n) = (P_{gain})^k \quad n = k*P,\ k = 0, 1, 2, 3, \ldots \tag{14}$$
$$p(n) = 0 \qquad n \text{ is not equal to } k*p$$

where $P_{gain}$ is the pitch gain and P is the pitch period. This sequence was windowed by a trapezoidal window to generate a finite sequence of length 2N. To generate a spectral response for only N points, a 2N-point complex FFT was taken of the sequence. The magnitude of the result, when normalized for unity gain, yielded the required spectral response, $F_{pitch}(k)$ In order to generate the final spectral estimate, the pitch striations and the spectral envelope were multiplied and normalized.

In graphing the combined pitch striation and spectral envelope information, the pitch striations appear as a series of "U" shaped curves wherein there exists P replications in a 2N-point window. This entire process was adaptively performed for each sample block. The problem with this prior technique was its implementation complexity. In the present invention, pitch striations are taken into account with a much simpler implementation.

Consider a case, in light of the previously described technique, where the pitch period is one (1) and the window used to generate a finite sequence is rectangular. The resultant spectral response of the pitch is a single "U" shape which will be defined for purposes of this application as follows:

$$STR(k) \text{ for } k=0, 2N-1. \tag{15}$$

It can be shown that for different values of the pitch period, other than one (1), the spectral response, $F_{pitch}(k)$, is solely a sampled version of STR(k), modulo 2N, i.e.

$$F_{pitch}(k)=STR(k*P)_{modulo\ 2N} k=0, N-1 \tag{16}$$

Additionally, it can be shown that the differences between the pitch striations (STR) for different values of $P_{gain}$, maintaining the same pitch period, when scaled for energy and magnitude, are mainly related to the width of the "U" shape. It can be shown that, based on the above, it is not necessary to adaptively determine the pitch spectral response for each sample block, but rather, such information can be generated by using information developed a priori. In one aspect of the present invention the pitch spectral response, $F_{pitch}(k)$, is adaptively generated from a look-up-table developed before hand and stored in data memory 22.

The development of this table is accomplished by using the prior technique, which was used adaptively for each sample block. However, for purposes of generating a look-up-table for use with the present invention, the pitch period is fixed at one (1) and the pitch gain is a given value. In the preferred embodiment the pitch gain utilized is 0.6. After this process is completed the Pitch Striations Look-Up-Table is defined by taking the logarithm to the base two of the result, i.e.:

$$STR(k)=\log_2(\text{Magnitude of FFT } [p(n)]/(STR_{energy})^{1/2})\ k=0,N-1 \tag{17}$$

The resulting table of logarithms is stored in memory. Before the look-up-table can be sampled to generate pitch information, it must be adaptively scaled for each sample block in relation to the pitch period and the pitch gain. The pitch period and the pitch gain are determined at 96 in the same fashion as the prior technique. This information is transmitted as side information on 97. The two parameters needed to scale the look-up-table are the energy and the magnitude of the pitch striations in each sample block. Having defined the sequence p(n) above, see (13), for any given pitch period and pitch gain, energy and magnitude are determined at 98 as follows:

$$STR_{energy}=\text{Sum } [p(n)^2]n=0, 2N-1 \tag{18}$$

$$STR_{mag}=\text{Sum } [p(n)\ ]n=0, 2N-1 \tag{19}$$

Based upon (18) and (19) the look-up-table scaling factor $STR_{scale}$ can be calculated at 100 as follows:

$$STR_{scale}=\log_2[STR_{mag}/(STR_{energy})^{1/2}] \tag{20}$$

The look-up-table stored in data memory 22 is multiplied by $STR_{scale}$ at 102 and the resulting scaled table is sampled modulo 2N at 104 to determine the pitch striations as follows:

$$F_{pitch}(k)=[STR_{scale}/STR(0)]*[STR(k*P)_{modulo\ 2N} k=0,N-1] \tag{21}$$

The sampled values, being logarithmic values, are thereafter added at 94 to the logarithmic variance values determined at 92.

Since $\log_2 v_i^2$ has been determined, it is now possible to perform bit allocation at 94. It will be recalled that equations (2)–(4) set out a known technique for determining bit allocation. Thereafter equations (6) and (7) were derived. Only one piece remains to perform simplified bit allocation. By substituting equation (6) in equation (4) it follows that:

$$R_{Total}=0.5*\ \text{Sum}_{i=1,N}[S_i]+N*\text{Gamma} \tag{22}$$

Rearranging (11) yields the following:

$$\text{Gamma}=[R_{Total}-0.5*\ \text{Sum}_{i=1,N}(S_i)]/\ N \tag{23}$$

where N is the number of samples per block and $R_{Total}$ is the number of bits available per block.

Figure 8:
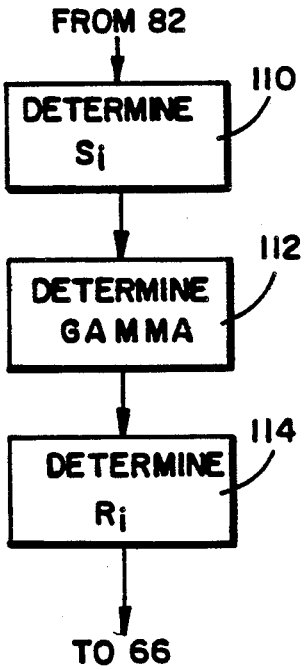
FIG. 8 is a more detailed flow chart of the integer bit allocation operation shown in FIGS. 3 and 4.
Figure 9:
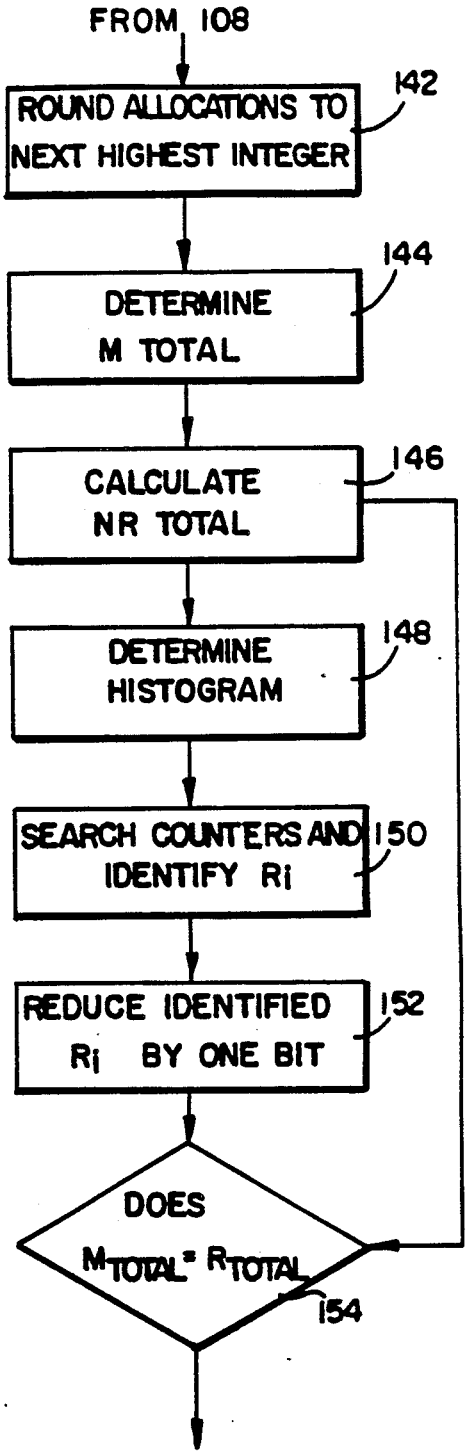
FIG. 9 is a flow chart of a preferred post bit allocation process which can be used in conjunction with the adaptive transform coder operation shown in FIGS. 3 and 4.
Figure 10:
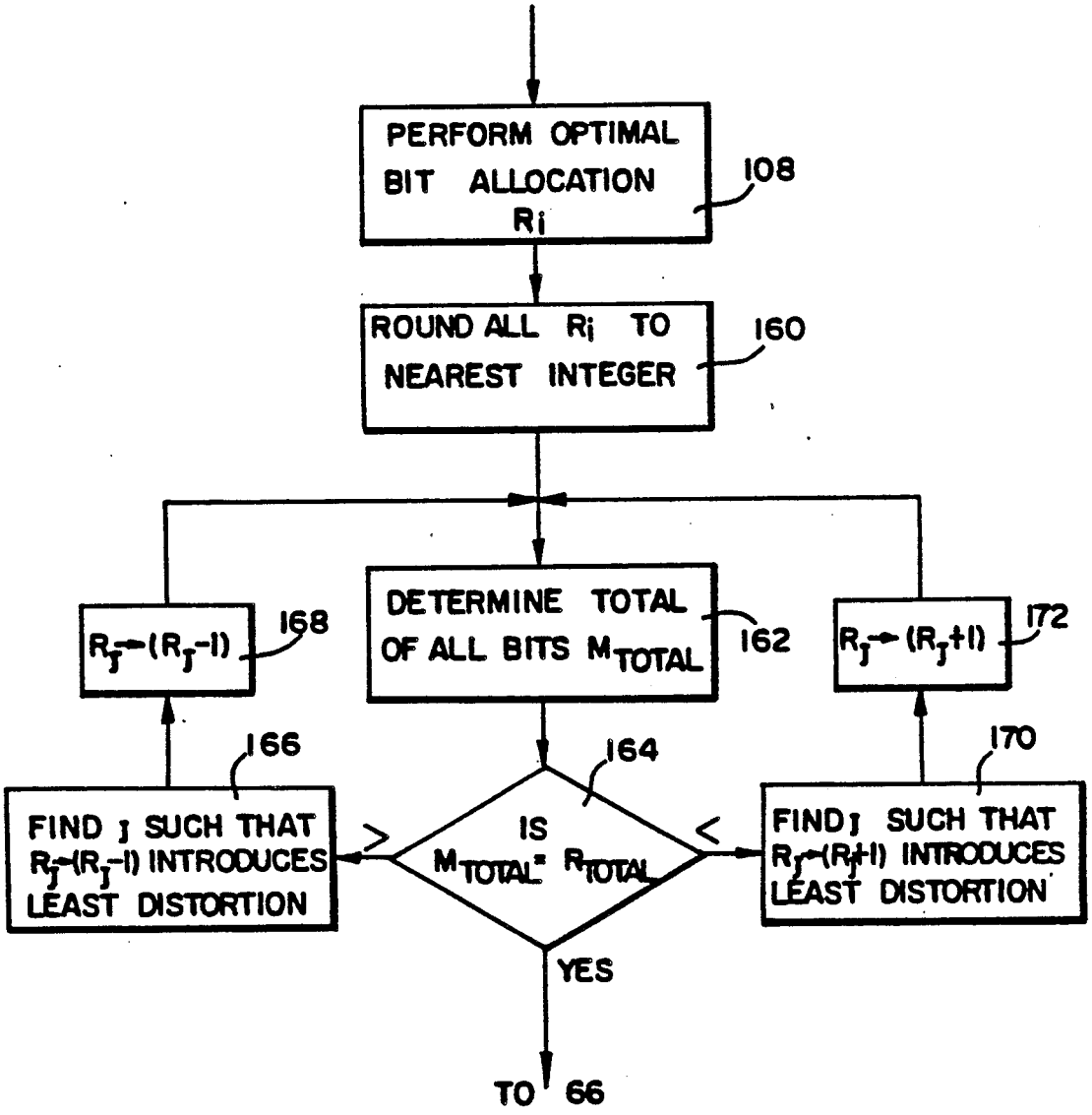
FIG. 10 is a flow chart of an alternative post bit allocation process which can be used in conjunction with the adaptive transform coder operation shown in FIGS. 3 and 4.

The bit allocation performed at 106 is shown in greater detail in FIG. 8. Utilizing (7), each $S_i$ is determined at 110, a relatively simple operation. Having determined each Si, Gamma is determined at 112 using (23), also a relatively simple operation. In the preferred embodiment, the number of samples per block is 128. Consequently, N is known from the beginning.

The number of bits available per block is also known from the beginning. Keeping in mind that in the preferred embodiment each block is being windowed using a trapezoidal shaped window and that eight samples are being overlapped, four on either side of the window, the frame size is 120 samples. Since transmission is occurring at a fixed frequency, 16 kb/s in the preferred embodiment, and since 120 samples takes approximately 15 ms (the number of samples 120 divided by the sampling frequency of 8 kHz), the total number of bits available per block is 240. It will be recalled that four bits are required for transmitting the dynamic scaling side information. The number of bits required to transmit the LPC coefficient side information is also known.

Consequently, $R_{Total}$ is also known from the following:

$$R_{Total}=240-\text{bits used with side information} \quad (24)$$

Since each $S_i$, $R_{Total}$, and N are all now known, determining Gamma at 96 is relatively simple using (23). Knowing each $S_i$ and Gamma, each $R_i$ is determined at 114 using (6). Again a relatively simple operation. This procedure considerably simplifies the calculation of each $R_i$, since it is no longer necessary to calculate the geometric mean, $V_{block}^2$, as called for by (2). A further benefit in utilizing this procedure is that using $S_i$ as the input value to (6) reduces the dynamic range problems associated with implementing an algorithm such as (2) in fixed-point arithmetic for real time implementation.

Having determined the quantization gain factor at 82 and now having determined the bit allocation at 108 the quantization at 66 can be completed. Once the DCT coefficients have been quantized, they are formatted for transmission with the side information at 116. The resultant formatted signal is buffered at 102 and serially transmitted at the preselected frequency, which in the preferred embodiment is 16 kb/s.

Consider now the adaptive transform coding procedure utilized when a voice signal, adaptively coded in accordance with the principles of the present invention, is received. It will be recalled that such signals are presented on serial port bus 14 by interface 28. Such signals are first buffered at 120 in order to assure that all of the bits associated with a single block are operated upon relatively simultaneously. The buffered signals are thereafter de-formatted at 122.

The LPC coefficients, pitch period, and pitch gain associated with the block and transmitted as side information are gathered at 124. It will be noted that these coefficients are already quantized. The spectral envelope and pitch striation information is thereafter generated at 126 using the same procedure described in reference to FIG. 7. The resultant information is thereafter provided to both the inverse quantization operation 128, since it is reflective of quantizing gain, and to the bit allocation operation 130. The bit allocation determination is performed according to the procedure described in connection with FIG. 8.

The bit allocation information is provided to the inverse quantization operation at 128 so the proper number of bits is presented to the appropriate quantizer. With the proper number of bits, each de-quantizer can de-quantize the DCT coefficients since the gain and number of bits allocated are also known. The de-quantized DCT coefficients are transformed back to the time domain at 132. Thereafter the now reconstructed block of samples are dynamically unscaled at 134, which is shown in greater detail in FIG. 5. Dynamic unscaling occurs at 136 by shifting the bits to the right by the formula:

$$\text{Right Shift}=[15-(\text{MSB}+1)] \quad (25)$$

Having been dynamically unscaled at 134 the sample block is now de-windowed at 138. It will be recalled that windowing allows for a certain amount of sample overlap. When de-windowing it is important to re-combine any overlapped samples. The sample block is again aligned in sequential form by buffer 140 prior to presentation on bus 18. Signals thus presented on bus 18 are converted from parallel to serial form by converter 30 and either output at 32 or presented to analog interface 36.

Figure 4:
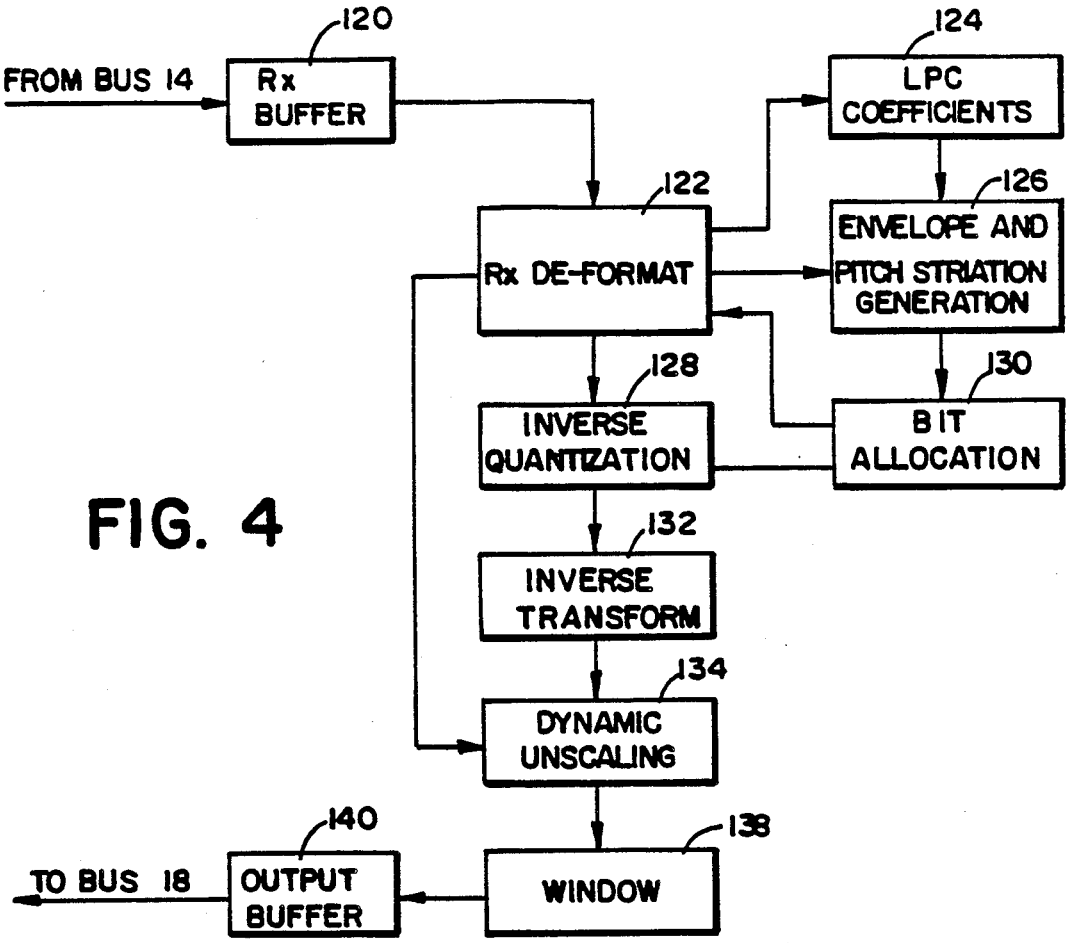
FIG. 4 is a general flow chart of those operations performed in the adaptive transform coder shown in FIG. 2, subsequent to reception.

Consider now a post bit allocation process which assures that the number of bits allocated per sample is an integer value. With reference to FIGS. 3 and 4, this post process would occur immediately after the bit allocation determinations have been made at 108 and 130 respectively and prior to presentation of the bit allocation information to any other operation. The post bit allocation process is shown in detail in FIG. 9. Generally, after the bit allocation determinations at 108, the post process rounds $R_i$ to the next positive integer and then removes bits from select $R_i$, until the total number of bits equals the number of bits available for bit assignment. This results in an assured integer bit allocation $M_i$ per DCT coefficient. However not just any bit is removed in the process. Bits are removed in relation to the amount of distortion associated with such removal. Assume that voice signals are being coded for transmission. After each $R_i$ has been determined at 108, the post process rounds each $R_i$ to the nearest integer at 142. Such rounding can be defined as follows:

$$M_i=\text{Integral}\ (R_i+0.99),\ \text{limit}\ 0-M_{max} \quad (26)$$

$$M_{Total}=\text{Sum}_{i=1,N}[M_i] \quad (27)$$

where:

$M_i$ is individual integer bit allocations;

$M_{max}$ is the maximum number of bits allowed per coefficient; and $M_{Total}$ is the total number of bits allocated in the block.

The total number of bits, $M_{Total}$, is thereafter determined at 144 according to (27). A determination is then made at 146 of how many bits need to be removed in order for $M_{Total}$ to equal $R_{Total}$ from the following:

$$NR_{total}=M_{Total}-R_{Total} \quad (28)$$

Thereafter a determination is made from which bit allocations one (1) bit will be removed so that $M_{Total}$ is equal to $R_{Total}$. This determination is made based upon the guideline that bits are to be removed from those legal bit allocations which will introduce the least amount of distortion by removing one (1) bit. A legal bit allocation is one which is greater than zero. Once the required bits have been removed from the desired allocations, the resultant bit allocation information is provided for quantization of the DC coefficients at 66.

In order to determine from which bit allocations one (1) bit will be removed, a histogram of the bit allocations is generated at 148. In order to generate the histogram, a number of counters are defined as each representing an identically sized but sequential range of the real numbers from 0.00 to 1.00. For example, in the preferred embodiment sixteen counters are defined as each representing 1/16 of the real numbers between 0.00 and 1.00, i.e. counter 1 represents numbers between 0.00 and 0.0625, counter 2 represents the real numbers between 0.0625 and 0.125, and so on. A counter is incremented by one for each value of $D_i$ falling within one of the defined ranges, which values are determined in relation to each of the calculated variances $v_i^2$ according to the following:

$$D_i = 2.72 * [v_i^2 / L_i^2] \quad (29)$$

where $D_i$ is the average distortion introduced by quantization of the $i_{th}$ coefficient; and $L_i$ is the integer level allocation ($L_i = 2^{M_i}$).

It should be kept in mind that a decrease of one bit will halve the number of quantization levels. Consequently, the following equations may be derived from (29):

$$D_i = 2.72 * v_i^2 * [1/(0.5L_i)^2 - 1/L_i^2] \quad (30)$$

hence:

$$D_i = 2.72 * v_i^2 * 0.75 * [1/L_i^2] \quad (31)$$

Unfortunately, these equations can be rather cumbersome. Since $D_i$ is a monotonically increasing function, the equation may be modified by another monotonically increasing function and obtain the same result. For example, multiplying by a constant or taking the logarithm to the base 2 will still indicate relative values, i.e., higher or lower. Consequently, the following can be developed:

$$D_i = \log_2 [v_i^2 / L_i^2] \quad (32)$$

hence:

$$D_i = R_i - M_i \quad (33)$$

Although equation (33) yields a different value for $D_i$ than equations (32), since the function is still monotonically increasing and since we are investigating related values, the result is still the same. Therefore the task of determining $D_i$ is reduced to simple equations.

Since certain bit allocations will be reduced by one bit, it is necessary to associate which allocation incremented which counter. Such association can be made by any known programming technique.

The counters are then searched at 150 from the counter representing the least amount of distortion 0.00 to the counter representing the greatest amount of distortion 1.00, accumulating the number of counts stored in each counter CUM(J), to determine and identify at which counter CUM(J) equal to or greater than $NR_{total}$.

Those bit allocations ($R_i$) represented by the distortions ($D_i$) associated with the counters whose ranges are less than the identified counter, are reduced by one bit at 152. In the identified counter, one bit is removed from each $R_i$ until CUM(J) equals $NR_{total}$. The $R_i$ from which one bit is removed are selected on the basis of smallest $D_i$ to largest $D_i$, as needed. The number of bit allocations represented in the identified counter from which a bit is removed shall be designated as K.

Once the selected bit allocations ($R_i$) have been reduced by one bit each, a determination is made as to whether $M_{Total}$ is equal to $R_{Total}$ at 154. If the answer is yes, the bit allocation information is presented to the quantizer. If the answer is no, as may happen if $NR_{total}$ is greater than the number of legal bit allocations ($R_i$), the process returns to 146 and repeats the process.

Consider now another process for assuring that the number of bits being assigned is an integer value. Again, after each $R_i$ has been determined at 108, this post process, shown in FIG. 10, rounds each $R_i$ to the nearest integer at 160. The total number of bits, $M_{Total}$, is thereafter determined at 162. An evaluation is made at 164 as to whether $M_{Total}$ is equal to $R_{Total}$. If $M_{Total}$ is equal to $R_{Total}$, the post process is over and the resulting $M_i$ are presented for quantization at 66. If $M_{Total}$ is greater than $R_{Total}$, then the bit allocation $R_j$ which would introduce the least amount of distortion if one bit were to be removed is determined at 166. One bit is removed from $R_j$ at 168 and the total number of bits is again determined at 162. The post process will continue looping in this manner until $M_{Total}$ equals $R_{Total}$.

If $M_{Total}$ is determined to be less than $R_{Total}$ at 164, then $R_j$ is located where the addition of one bit would decrease distortion the most at 170. Having located $R_j$, one bit is added to $R_j$ at 172. $M_{Total}$ is again determined at 162 and the process will so loop until $M_{Total}$ is found to equal $R_{Total}$ at 164.

In order to determine that $R_j$ where the least amount of distortion will occur if a bit is subtracted or where distortion will be reduced the most if one bit is added consider the following:

$$M_i = \text{Integral}\ (R_i + 0.5),\ \text{limit}\ 0 - M_{max} \quad (34)$$

$$M_{Total} = \text{Sum}_{i=1,N}\ [M_i] \quad (35)$$

$$N_{Iter} = R_{Total} - M_{Total} \quad (36)$$

$$D_i = 2.72 * [v_i^2 / L_i^2] \quad (37)$$

$$D_{Total} = \text{Sum}_{i=1,N}\ [D_i] \quad (38)$$

where:

$M_i$ is individual integer bit allocations;

$M_{max}$ is the maximum number of bits allowed per coefficient;

$M_{Total}$ is the total number of bits allocated in the block;

$N_{Iter}$ is the number of iterations required to increase or decrease bit allocation to $R_{Total}$;

$D_i$ is the average distortion introduced by quantization of the $i_{th}$ coefficient;

$L_i$ is the integer level allocation ($L_i = 2^{M_i}$); and $D_{total}$ is the total average distortion introduced to the block by quantization.

Equation (34) defines the integer bit allocation, $M_i$, which is derived from $R_i$ by rounding to the nearest integer and limiting the result to a positive integer no greater than $M_{max}$. This results in a total number of bits allocated, $M_{Total}$, which must be increased or decreased by $N_{Iter}$ bits (36) in order to maintain the correct number of bits allocated to the block, $R_{Total}$.

In determining which coefficients require a modification of their bit allocation, the measure of distortion associated with this operation per coefficient is determined. MAX defined the average distortion introduced by quantizing a sample in (37). This result was used previously to define optimal bit allocation (2). The approach used is to modify the integer allocation $M_i$ to equal $R_{Total}$ bits by determining iteratively the bit that introduces the least distortion by being removed (dec), or the one that reduces the total distortion most by being increased (inc). If left to the above equations, this procedure is constrained to positive integers not greater than $M_{max}$.

It will again be kept in mind that an increase of one bit will double the number of levels, and that a decrease of one bit will half the number of levels. Therefore the following equations may be derived from (37):

$$D_{(inc)} = 2.72 * v_i^2 * [1/L_i^2 - 1/(2L_i)^2] \quad (38)$$

-continued hence:

$$D_i(inc) = 2.72 * v_i^2 * 3.0 * [1/L_i^2] \quad (39)$$

$$D_i(dec) = 2.72 * v_i^2 * [1/(0.5L_i)^2 - 1/L_i^2] \quad (40)$$

hence:

$$D_i(dec) = 2.72 * v_i^2 * 0.75 * [1/L_i^2] \quad (41)$$

Therefore, to increase the number of bits, $D_i$(inc)(39) defines the reduction in total distortion, $D_{total}$ by increasing $M_i$ by one bit. Consequently the iterative process must determine the maximum $D_i$(inc) in the block (i=1,N). Similarly, to decrease the number of bits, $D_i$(-dec)(41) defines the increase in the total distortion by decreasing $M_i$ by one bit. Consequently, the iterative process must determine the minimum $D_i$(dec) in the block (i=1,N).

However the above equations can be rather cumbersome. The operation of searching for a minimum or maximum is based on the fact that $D_i$(inc) and $D_i$(dec) are monotonically increasing functions with respect to $v_i$ and $L_i$. As such they may be modified by any other monotonically increasing function and maintain the correct result. For example, multiplying by a constant or taking the logarithm to the base 2 will still indicate relative values, i.e., higher or lower. Consequently, the following can be developed:

$$D_i(inc) = \log_2 [V_i^2/L_i^2] \quad (42)$$

hence:

$$D_i(inc) = R_i - M_i \quad (43)$$

$$D_i(dec) = \log_2 [v_i^2/L_i^2] \quad (44)$$

hence:

$$D_i(dec) = R_i - M_i \quad (45)$$

Although equations (43) and (45) yield different values for $D_i$ than equations (42) and (44), since the function is still monotonically increasing and since we are searching for a maximum, the result is still the same. Therefore the task of determining $D_i$ at 166 or 170 is reduced to simple equations.

While the invention has been described and illustrated with reference to specific embodiments, those skilled in the art will recognize that modification and variations may be made without departing from the principles of the invention as described herein above and set forth in the following claims.

What is claimed is :

1. Apparatus for developing pitch information in relation to a given speech signal in a transform coder, which coder operates on a sampled time domain information signal composed of information samples by sequentially segregating groups of information samples into blocks, by transforming each block of samples from the time domain to a transform domain, and by generating an auto-correlation function of the transformed signal for each block, and which coder includes a data memory, said apparatus comprising, pitch means for determining the pitch period and the pitch gain from said auto-correlation function;

striation means for determining the striation magnitude and energy from said pitch period and pitch gain;

reference means for retrieving from said data memory a reference pitch, model which model includes a number of data points wherein said data points are representative of a model pitch striation;

scaling means for generating a striation scaling factor in response to said magnitude and energy;

multiplication means for multiplying said striation scaling factor by each of said data points thereby generating a current pitch model having a number of adaptively determined points; and sampling means for sampling said adaptively determined points which sampling establishes said pitch information.

2. The apparatus of claim 1, wherein said striation means determines said magnitude and energy according to the formulae:

$$STR_{energy} = \text{Sum } [p(n)^2] \quad n = 0, 2N - 1$$

$$STR_{mag} = \text{Sum } [p(n)] \quad n = 0, 2N - 1$$

where p(n) is a time domain impulse sequence defined as follows:

$$p(n) = (P_{gain})^k \quad n = K*P, k = 0, 1, 2, 3, \ldots$$

$$p(n) = 0 \quad n \text{ is not equal to } k*p.$$

3. The apparatus of claim 2, wherein said scaling means generates said scaling factor according to the formula:

$$STR_{scale} = \log_2[STR_{mag}/(STR_{energy})^{1/2}].$$

4. A method for developing pitch information in relation to a given speech signal in a transform coder, which coder operates on a sampled time domain information signal composed of information samples by sequentially segregating groups of information samples into blocks, by transforming each block of samples from the time domain to a transform domain, and by generating an auto-correlation function of the transformed signal for each block, said method comprising the steps of:

generating a reference pitch model which model includes a number of data points and storing said model in said data memory;

determining the pitch period and the pitch gain from said auto-correlation function;

determining the striation magnitude and energy from said pitch period and pitch gain.

retrieving from said data memory a reference pitch model which model includes a number of data points wherein said data points are representative of a model pitch striation;

generating a striation scaling factor in response to said magnitude and energy;

multiplying said striation scaling factor by each of said data points thereby generating a current pitch model having a number of adaptively determined points; and sampling said adaptively determined points which sampling establishes said pitch information.

5. Apparatus for generating a reference pitch model comprising:

definition means for defining a time domain impulse sequence, p(n) as follows:

$$p(n) = (P_{gain})^k \quad n = k*P, k = 0, 1, 2, 3, \ldots$$

$$p(n) = 0 \quad n \text{ is not equal to } k*p$$

where $P_{gain}$ is a predetermined value and P is one;

windowing means for generating a finite sequence of length 2N of said time domain impulse sequence utilizing a rectangular window;

FFT means for generating a spectral response of values of said finite sequence using a 2N-point complex FFT;

magnitude means for determining the magnitude of said values of said spectral response;

energy means for determining the energy of values of said spectral response;

scaling means for scaling said magnitude by said energy; and logarithmic means for taking the logarithm to a predetermined base of the result of scaling said values.

6. A method for generating a reference pitch model comprising the steps of:

defining a time domain impulse sequence, p(n) as follows:

$$p(n) = (P_{gain})^k \quad n = k*P,\ k = 0, 1, 2, 3, \ldots$$

$$p(n) = 0 \quad n \text{ is not equal to } k*p$$

where $P_{gain}$ is a predetermined value and P is one;

generating a finite sequence of length 2N of said time domain impulse sequence utilizing a rectangular window;

generating a spectral response of values of said finite sequence using a 2N-point complex FFT;

determining the magnitude of said values of said spectral response;

determining the energy of values of said spectral response;

scaling said magnitude by said energy; and taking the logarithm to a predetermined base of the result of scaling said values.

7. Apparatus for developing pitch information in relation to a given speech signal in a transform coder, which coder operates on a sampled time domain information signal composed of information samples, by sequentially segregating groups of information samples into blocks, transforming each block of samples from the time domain to a transform domain, and by generating an auto-correlation function of the transformed signal for each block, and which coder includes a data memory, said apparatus comprising, pitch means for determining the pitch period and the pitch gain from said auto-correlation function;

reference means for retrieving from said data memory a reference pitch model which model includes a number of data points, wherein said data points are representative of a model pitch striation;

scaling means for generating a striation scaling factor in relation to said pitch period and pitch gain;

modification means for modifying said data points in relation to said scaling factor thereby generating a current pitch model having a number of adaptively determined points; and sampling means for sampling said adaptively determined points which sampling established said pitch information.

8. A method for developing pitch information in relation to a given speech signal in a transform coder, which coder operates on a sampled time domain information signal composed of information samples, which coder sequentially segregates groups of information samples into blocks, transforms each block of samples from the time domain to a transform domain, and generates an autocorrelation function of the transformed signal for each block, said method comprising the steps of:

generating a reference pitch model which model includes a number of data points and storing said model in said data memory;

determining the pitch period and the pitch gain from said auto-correlation function;

retrieving from said data memory a reference pitch model which model includes a number of data points, wherein said data points are representative of a model pitch striation;

generating a striation scaling factor in relation to said pitch period and pitch gain;

modifying said data points in relation to said scaling factor thereby generating a current pitch model having a number of adaptively determined points; and sampling said adaptively determined points which sampling establishes said pitch information.

* * * * *